United States Patent [19]

Mamo

[11] 4,320,989

[45] Mar. 23, 1982

[54] METHOD FOR MOVING ICEBERGS IN A BODY OF WATER AND RELATED APPARATUS

[76] Inventor: Anthony C. Mamo, 1515 E. Central Ave., Apt. 264-B, Arlington Heights, Ill. 60005

[21] Appl. No.: 95,978

[22] Filed: Nov. 20, 1979

[51] Int. Cl.[3] ..... E02B 1/00; E02B 15/02

[52] U.S. Cl. ..... 405/52; 405/22; 405/61

[58] Field of Search ..... 405/22, 52, 60, 61, 405/62, 211; 114/242, 245, 253

[56] References Cited

U.S. PATENT DOCUMENTS

| | | | |
|---|---|---|---|
| 2,382,393 | 8/1945 | Bille | 405/22 |
| 2,401,929 | 6/1946 | Hammond | 114/245 X |
| 3,405,527 | 10/1968 | Farr et al. | 405/61 |
| 3,585,802 | 7/1971 | Frankel | 405/52 X |
| 4,030,305 | 6/1977 | Wilson | 405/61 |
| 4,199,273 | 4/1980 | Mougins | 405/52 |

*Primary Examiner*—David H. Corbin

*Attorney, Agent, or Firm*—Balogh, Osann, Kramer, Dvorak, Genova & Traub

[57] ABSTRACT

A low cost method for transporting an iceberg from one location to another in a body of water without the need of boarding, or physical pushing or pulling contact therewith. The method involves the releasing of a large volume of air bubbles underwater in specific proximity to a portion of the floating iceberg. The bubbles are formed by allowing air to escape from openings in a submerged tube structure to form a shroud or wall of many bubbles. The bubbles are released in such areas as to provide bubble envelopment of a portion of the subsurface of the iceberg. Primarily, this raises the water surface of a peripheral portion of the iceberg to result in an increase in pressure and movement of the iceberg away from the bubble-enveloped side of the iceberg.

24 Claims, 5 Drawing Figures

FIG. 1
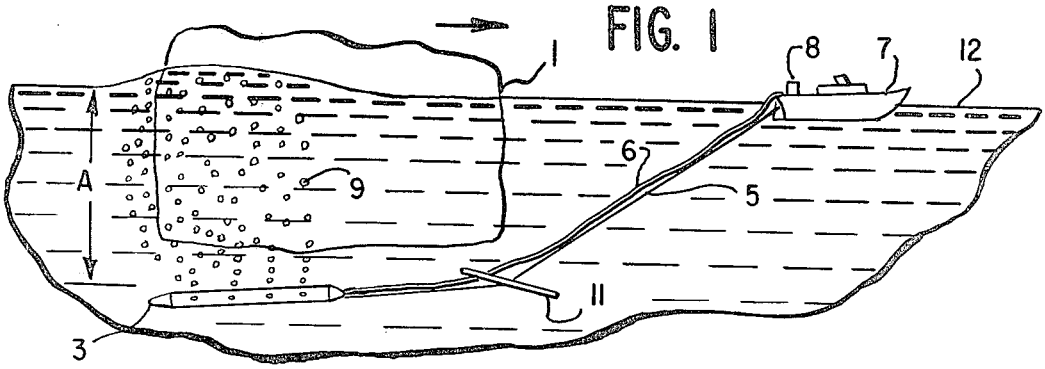
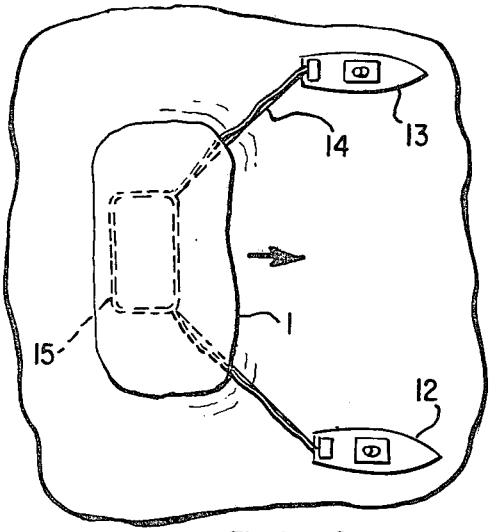
FIG. 2
FIG. 3
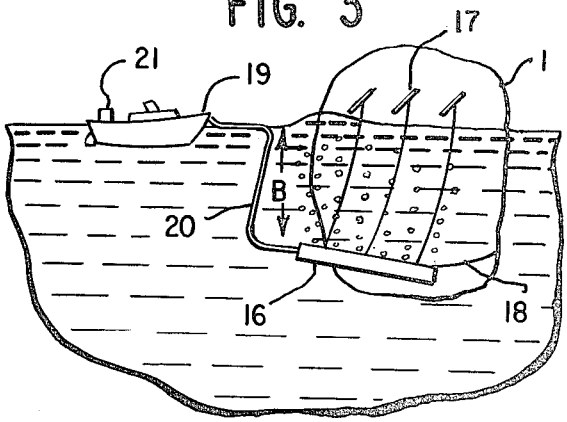
FIG. 4
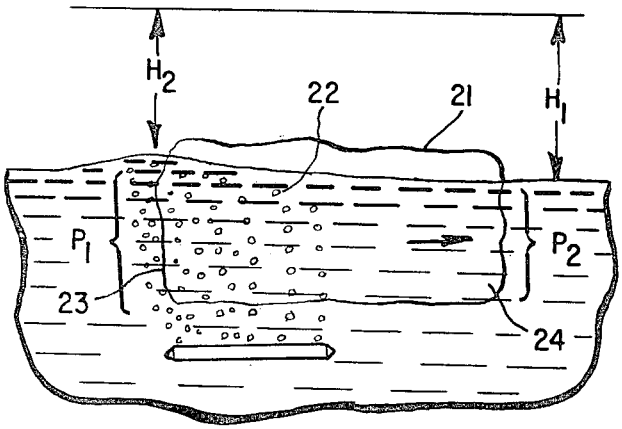
FIG. 5
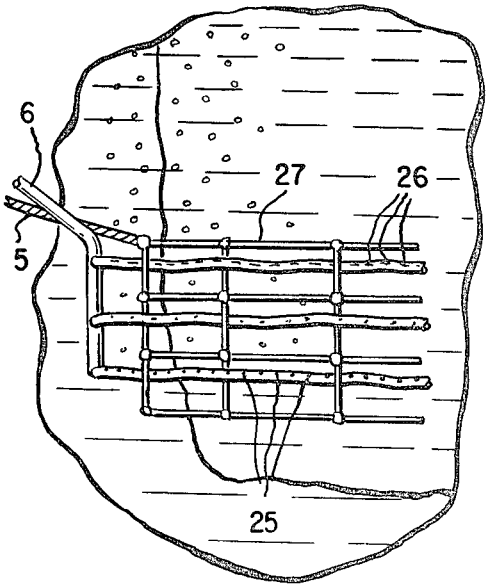

METHOD FOR MOVING ICEBERGS IN A BODY OF WATER AND RELATED APPARATUS

BACKGROUND OF THE INVENTION

The invention relates to a new and improved method for moving icebergs from one location to another in a body of water.

Icebergs constitute large masses of floating ice found in both the Northern and Southern Hemispheres. North Atlantic icebergs are formed from glaciers in the Artic Circle, i.e., the ice cap of Greenland, while South Alantic icebergs originate from the Antarctic ice shelf.

Icebergs are found in various shapes, sizes, and weights, and may continue growing in size in cold polar waters for indefinite periods, They may also drift under the influence of ocean currents to warm waters, whereby they melt and disintegrate by wave erosion and warmer temperatures.

Throughout the ages, icebergs have been known as a source of fresh water (as distinguished from frozen sea water) for sailors and sailing ships in distress. In modern times, there is an ever increasing interest in icebergs as a source of fresh water and cooling media, especially for arid or desert countries. However, there has been always the problem of moving or transporting the icebergs at low cost from the polar regions where they originate, to some other desirable destination. The tremendous mass, shape, and nature of icebergs make their transportation a complicated and formidable problem. Normally, ocean winds and ocean currents and temperatures determine the drift life and destination of icebergs.

There is therefore, a growing need for devising methods for safe and low cost transportation of icebergs from their natural drifting lanes to other more useful destinations.

Another factor stressing the need for developing such methods surfaces when icebergs drift into North and South Atlantic shipping lanes and fishing grounds, endangering the same for indefinite periods of time and becoming hazards to navigation.

Since usually only about one-seventh to one-tenth of the mass of an iceberg projects above the water, it is quite difficult for navigators approaching it to determine with any degree of accuracy the shape and dimensions of its submerged portion. During hours of darkness or during springtime, icebergs may be accompanied by a blanket of fog, which increases the danger to ships, passengers, and cargo at sea.

Many attempts were made in the past to reduce or eliminate the hazards introduced by drifting icebergs, through the use of tracking surveillance and detection methods. The known methods provide for the reduction of the hazard by disintegrating drifting icebergs by means of explosives and incendiary materials, or by covering the icebergs with lampblack to increase the rate of heat absorption and make them melt faster.

However, all these methods are costly and have serious drawbacks because they fail to dispose of all of the ice and thus are only partly successful in eliminating the hazards.

Current methods under development may be used for both the elimination of the aforesaid hazards to navigation, and for transporting icebergs to particular destinations, where the ice has a commercial valve, and according to these methods, the icebergs are physically moved by towing via lines attached to ships or boats.

But these involve great expenditure of energy equipment and manpower.

These methods are highly inefficient and costly. Several large ships or tow boats moving at inefficient low speeds expend large amounts of energy for the movement of even a relatively small iceberg.

The overall efficiency from the standpoint of energy consumption of towing an iceberg by using tow ships or tow boats is in the area of 2½ due to the low velocity involved, adverse effect of wake caused by towing vessels, and the non-parallelism of tow lines. The proposed system has an efficiency that is several times greater. This is due to the fact that the present invention eliminates the need for use of numerous towing ships, and reduces the parasitic weight of the towing medium by factors of 3 to 6. It also reduces, approximately 98% of the adverse reverse wake effect caused by the towing ship or ships. It also eliminates the losses due to the lack of combined parallelism of multiple towing ships.

With the proposed system, the problems described above are eliminated or reduced by approximately 100,000 to 1.

Another advantage of the present invention is that it eliminates calving or breaking up of the iceberg mass due to stress concentrations caused by driving and anchor forces of multiple tow lines attached to the iceberg. The preferred embodiment of the present invention contemplates feather-soft, uniform driving forces to move the iceberg without the need for boarding.

Also, when moving or transporting an iceberg, there is the problem of iceberg stability. During the voyage, under the conventional system, all tow lines must pull through the center of gravity to minimize tipping. Since an iceberg may melt unevenly, and as a result, shift in position and tumble in the water, severe hazards are involved in conventional towing methods which require attachment of tow lines, and the possibility of capsizing of towing boats is great. Also, melting causes a change in the center of gravity and relocation of attachment points of tow lines. The center of gravity, of course, is nearly impossible to locate, with any degree of accuracy.

The present invention goes a long way toward resolving all of these problems confronted in the prior art by providing for a low cost efficient and safe method for moving icebergs from one location to another, at a reduced melt rate.

SUMMARY OF THE INVENTION

The general aim of the present invention is to provide a new and improved method and apparatus for low cost transportation of icebergs from one location to another in a body of water, and in which contact with the iceberg is not necessary, and whereby the uniform driving forces always act on a near perfect center of gravity.

A principal object of the invention is to provide an efficient method and apparatus which is relatively simple and inexpensive and uses readily available means and devices. The particular construction of the device used in performing the method of the present invention enables easy, safe, and yet effective steerable transportation at several times the efficiency of prior art methods.

A further object is to provide a low cost, safe, non-contact method and apparatus for the removal of drifting icebergs from shipping lanes and fishing grounds where they constitute a hazard to navigation, property, and human life.

A further object of the invention is to provide a much slower ice melt rate of the icebergs, for any given water temperature. Under the concept of the present invention, a certain portion, approximating one-half, of the submerged surface of the iceberg will be surrounded by multiple curtains of billions of air bubbles, and since air has approximately one-twenty fourth of the thermal conductivity of water, the melting rate of the ice surface exposed to the air bubble curtain will be greatly reduced.

Another object of the present invention is to provide a moving force against an iceberg that will effectively be a gentle force acting essentially through the center of gravity, and minimizing dangers of tumbling and calving.

A further object of the present invention is to provide an iceberg transport means which does not require contact or the boarding of the iceberg, thereby promoting a greater degree of safety in operation.

Another object is to provide an iceberg transport means that eliminates adverse wake effects of towing boats or ships.

In the proposed system the reverse wake effect is reduced by approximately 100,000 to 1 as the magnitude of the reverse wake is proportional to the combined towline tension (combined horsepower expended in towing). In the new system, the towline tension is only the required to pull the bubble network, not the iceberg mass which is millions of times greater.

Another object is to provide an iceberg transport means that eliminates the problem of lack of parallelism of tow lines and stress concentrations caused by securing lines to the iceberg, and which result in calving, and/or tipping.

In accordance with the present invention, the method includes the positioning but not necessarily the securing of one or more perforated tubes to or near a floating iceberg, with at least part of the tubes being submerged in water, beneath part of the iceberg, and connecting the tubes to one or more air compressors aboard a vessel or floating device, and forcing air or gas under pressure into the tubes at a predetermined pressure, and volume discharging the air from the tubes under water and forming a wall of tiny bubbles around approximately one-half of the submerged surface of the iceberg at the section thereof opposite from the direction of intended movement thereof. This elevates the water level around approximately one-half of the periphery of the iceberg at the water line, and causes the iceberg to laterally be forced downhill or away from the bubble wall.

The details of operation and objects and advantages of the invention will become more apparent from the following description when taken in conjunction with the accompanying drawings.

BRIEF DESCRIPTION OF THE DRAWINGS

FIG. 1 is an elevational view of one form of the device used in performing the method of the present invention where a single boat is used, and the bubble release tube structure is not fixedly secured to the iceberg.

FIG. 2 is a top plan view of another form of the device used to carry out the method of this invention, whereby two laterally disposed boats or ships guide and support the bubbles release structure which is not fixedly secured to the iceberg.

FIG. 3 is another form of the device used to carry out the method of the present invention, whereby the bubble release structure is fixedly supported from the iceberg, and a single guide ship for providing air supply following behind the iceberg.

FIG. 4 is a pictorial presentation of the principals involved in this invention.

FIG. 5 illustrates the nature of the tubing used for release of bubbles below the water surface.

DETAILED DESCRIPTION OF THE INVENTION

Referring now to the Figures of drawings which show simple forms of carrying out the invention, it is believed that the nature of the invention and its operation and its contribution to the art will be clearly understood.

As illustrated in FIG. 1, an iceberg 1 of indeterminate shape is afloat in a body of water 2, and a network of perforated tubes 3 is positioned beneath the iceberg 1 at a depth level A, in this embodiment, beneath the iceberg 1. The tubing network 3 is towed by a cable 5 and is connected to an air supply line 6 that is carried to ship 7, on which are located a series of heavy-duty air compressors 8. Therefore, the compressors pump air or other gas under pressure into air conduit 6 leading to the network of perforated tubes 3 beneath the iceberg 1. This creates a wall or curtain of bubbles of gas or air which seek their way upwardly to the water surface. Specific disposition of the network of perforated tubes is essential in order that the curtain of bubbles 9 should be in that section of the iceberg opposite from the direction of intended movement of the same.

The depth and positioning of the submerged network of perforated tubes can be determined by technical apparatus commercially available and in the nature of underwater sounding or television equipment or simple surface buoys or the like.

The curtain of bubbles acting against the submerged portions of a section of the iceberg will cause the iceberg to move in an opposite direction to the curtain of bubbles, as will be explained hereinafter. As the iceberg moves, it is necessary that the ship 7 maneuver in an appropriate manner to keep the network of perforated tubes 3 in the proper relative position with respect to the iceberg.

During the course of movement, the tow cable 5 connected between the ship 7 and the network of perforated tubes 3, may have connected to it appropriate weight and or pneumatically controlled aileron 11, which will prevent the tow cable 5 and air supply line 6 from being pulled upwardly into contact with the iceberg 1. In most cases or in the case of an iceberg having a substantially flat bottom, there would be no need to take measures to prevent the tow cable 5 from coming into contact with the iceberg, nor to keep the network of perforated tubing from rising and contacting the bottom flat surface of the iceberg as the upward force is negligable due to the low tow line tension, velocity and mass of the bubble network.

FIG. 2 of the drawings illustrates another embodiment of this invention, whereby, instead of using a single control ship 7, there are utilized two control ships 12 and 13, which are disposed on lateral sides of the iceberg 1, having regard to the direction of intended movement. Control ships 12 and 13 are each connected by a cable 14 to a network of perforated tubing 15 disposed beneath, but not necessarily touching the iceberg 1. The function of the two ships is the same as the function of the single ship in the embodiment shown in FIG. 1 in that one or both of the ships carry air or gas compressor machinery which pumps compressed air or gas to the network of perforated tubing 15, and also the two ships maintain between them and in proper disposition beneath the iceberg 1, the bubble-production network of perforated tubing.

The use of two ships in position laterally of the direction of intended motion of the iceberg produces a situation where no adverse reverse ship wake will be acting upon the iceberg. It should be stated, however, that even with towing by a single ship ahead of the iceberg, there is practically no adverse wake effect because the towing force here is relatively small and the horse power is only enough to keep the towed tubing network moving at a very slow speed. This is compared to several heavy tow ships which must deliver thousands of horsepower in an attempt to move the immense mass of the iceberg, which situation creates a strong and adverse reverse wake effect against the icebergs direction of motion.

The use of two ships towing a network of perforated tubing under the iceberg permits steering of the direction of movement of the iceberg by appropriate shifting of the position of the network of tubing. The direction of movement of the iceberg will always be away from the area of greatest concentration of air bubbles.

Steering is accomplished in the same manner when a tow boat is used, as shown in FIG. 1.

In still further embodiment of this invention, as shown in FIG. 3, and which might be used when the floating iceberg assumes a more compatible shape and mass, the network of perforated tubing 16 is secured to a portion of the peripheral surface of the iceberg 1 at a depth level B. Securing may be accomplished by means of a girdling belt or a gun-harpoon and cable 18, from which the network of perforated tubing is suspended. In this embodiment, it is perferable for the control ship 19 to follow behind the moving iceberg, and the only interconnection necessary between the ship 19 and the network of perforated tubing 16 is air conduit 20. The control ship 19, of course, contains appropriate air or gas compressor equipment 21.

Steering of the iceberg in this embodiment is accomplished by the use of a conventional valve that controls the volume of compressed air going to the left or right side of the perforated tubing 16. Movement to the right is accomplished by reducing the supply of air to the tubing on the right side of the iceberg. Movement to the left is accomplished by reducing the supply of the air to the tubing on the left side of the iceberg.

FIG. 4 of the drawings illustrates the principle upon which movement of the iceberg is accomplished through the principle of this invention.

The drawing shows a solid floating iceberg 21 with a mass of air bubbles 22 in the form of a blanket surrounding a substantial portion of the submerged portion of the floating iceberg. The mass of bubbles causes the level of the water to rise slightly at the surface of a portion of the iceberg. Therefore, with respect to a reference plane that is horizontal above the surface of the water, the distance H2 will be slightly less than the distance H1. This results in a greater net force against the surface 23 than is experienced against the surface 24, the forces being represented by P1 and P2, respectively. The net result is that there is a net force causing the floating iceberg to move to the right, away from the direction of the blanket of bubbles.

The perforated tube network is shown in detail in FIG. 5. The tubes can be of plastic or rubber or non-corrosive metal or a sintered porous material. The ports or openings 26 for release of air under pressure are in the form of self-sealing slits that prevent passage of air below a predetermined pressure. The ports or openings 26 are distributed in a spaced relationship over the entire surface of each of the tubes of the network.

Where multiple tubes are to be used below the water surface to emit bubbles around the side of an iceberg, the tubes may be spaced for convenience by spacing members 27 or any rigid grid member to avoid tangling and fouling of the tubes. Any rigid lattice work structure through which the tubing can be laced will serve the purpose.

The tubing can be provided with holes 25 or slots or slits 26 for emitting bubbles of gas or air, and these holes or slots or slits are preferably of 0.0001 to 0.725 inches diameter. If a pliable plastic or rubber tubing is used, slits in the surface of the tubing can be used, such slits being self-sealing or of such nature that air or gas will not escape from within the tube unless there is a substantial over-pressure or a predetermined pressure is reached within the tube. Slots or slits cut into the tubing must be of limited depth and length to avoid undue weakening of tubing. The slots or slits should preferably be disposed angularly rather than transverseley with respect to the longitudinal axis of the tubing in order to provide a maximum length of slot or slit with the least amount of weakening of the tubing.

If a pliable plastic or rubber tubing is used, the air escape outlets in the tubing may be in the form of punctures rather than holes, so that air will not escape from the tubing until a predetermined pressure exists in the tube The pressure of air or gas within the tube should be at least 0.433 psi per foot of depth of the tube under the water surface. The greater the pressure, the greater the volume of bubbles released and the greater the temperature drop due to the Joule-Thomson effect, to be discussed later.

The greater the volume of bubbles, the greater will be the moving force exerted against the iceberg.

The volume of air pumped to the tube network can be based on the relationship:

$$V = \frac{B}{K} \cdot S$$

Where

V equals volume in cubic feet per minute,

B equals the surface periphery in feet,

K equal the length to width factor, of the iceberg and is from 1 to 8; and

S depends on mass, depth and the desired velocity of the iceberg and ranges from 0.2 to 20.

A submerged surface of an iceberg that is subjected to contact with a curtain of bubbles will experience a slower melting rate than the surface exposed to water alone. This is due to the fact that a curtain of air bubbles will insulate the surface of the submerged iceberg from contact with the warmer water.

Also due to the Joule-Thomson effect (dT/dp) there is a cooling effect on air that is compressed and throttled through an opening in the tube and released. The drop in pressure of the air causes a drop in temperature of the air. This cool wall of air bubbles causes a cooling effect on the surface of the submerged iceberg and tends to reduce the melt rate of the iceberg to a certain extent.

These are obviously advantageous characteristics.

Though the invention has been described with respect to a specific preferred embodiment thereof, many variations and modifications thereof will immediately become apparent those skilled in the art. It is, therefore, the intention that the appended claims to be interpreted as broadly as possible in view of the prior art to include all such variations and modifications.

What is claimed is:

1. A method for moving an iceberg in a body of water, comprising the steps of:

disposing one or more tube means which are capable of passing air through their walls below water level, in a predetermined position with respect to the floating iceberg, said position being at the section of the iceberg opposite from the direction of intended movement of the same;

connecting the tube means to a source of a gas medium under pressure;

pumping the gas medium at a predetermined pressure and volume into the tube means; and discharging the gas medium through the walls of the tube means, and forming a wall of gas bubbles that surrounds and acts against a substantial portion of the submerged iceberg, said portion of the iceberg being at the section thereof, opposite from the direction of intended movement of the iceberg, said wall of gas bubbles, which bubbles seek their way upwardly to the water surface, elevating the water level around said portion of the iceberg such that the net force acting on the iceberg through the center of gravity thereof causes it to move away from the wall of gas bubbles and in the direction of intended movement of the same.

2. The method as claimed in claim 1, comprising the step of securing the gas medium-passing tube means directly to the iceberg by physical means.

3. The method as claimed in claim 2, wherein the tube means is secured to the iceberg by suspension cable means secured to the above-water surface of the iceberg.

4. The method as claimed in claim 2, wherein the tube means is secured to the iceberg by belt means encircling at least a portion of the iceberg.

5. The method as claimed in claim 1, comprising the steps of:

maintaining the tube means at a predetermined position under part of the iceberg; and towing the tube means to maintain it in the predetermined position during movement of the iceberg.

6. The method as claimed in claim 5, wherein the towing of the tube means is accomplished by using one or more ships.

7. The method as claimed in claim 1, comprising the step of pumping a predetermined volume of air into said tube means sufficient to cause the water level at the section of the iceberg surrounded by gas bubbles, to be higher than the water level at the other section of the iceberg which is not exposed to bubbles.

8. The method as claimed in claim 1, comprising the step of pumping air into said tube means at an over-pressure and permitting the air to release and drop in pressure to produce a temperature drop due to Joule-Thomson effect and produce a wall of cooled air bubbles in contact with the submerged surface of the iceberg to reduce the melt rate of the iceberg in comparison to the melt rate of the iceberg surface not exposed to the wall of bubbles.

9. The method as claimed in either of claims 7 or 8, wherein the pressure and volume of air pumped into the tube means is optimized to maximize the iceberg velocity of travel and cooling rate.

10. The method as claimed in claim 9, wherein the volume of air pumped into the tube means is determined by the relationship:

$$V = \frac{B}{K} \cdot S$$

where

V equals volume of air in cubic feet per minute,

B equals the surface periphery of the iceberg in feet,

K equals the length to width factor of the iceberg, ranging from 1 to 8, and

S equals a factor determined by mass, depth and desired velocity of movement and ranges from 0.2 to 20.

11. The method of claim 6, wherein the towing ship operates below the surface of the water.

12. The method of claim 1, wherein the tube means are disposed beneath the surface of the water at a predetermined depth.

13. The method of claim 1, wherein air pumped to the tube means is received from compressor means disposed on one or more floating ships spaced apart from the iceberg.

14. The method as claimed in claim 2, wherein steering of the direction of movement of the iceberg is accomplished by controlling the source of air to alternate sides of the tube means.

15. The method of claim 5, wherein steering of the direction of movement of the iceberg is accomplished by regulating the position of the tube means beneath the iceberg.

16. The method of claim 5, wherein the depth position of the tube means is maintained by using a controllable airleron connected to a tow line between the towing ship and the tube means.

17. The method as claimed in claim 1, wherein the volume, pressure and location of the expelled air causes the water level to be elevated around a predetermined peripheral portion of the water and iceberg interface.

18. Apparatus for moving an iceberg in a body of water, comprising:

means for emitting and forming a wall of bubbles of air, means for providing air under pressure to said emitting and forming means, and means for moving said emitting and forming means and maintaining the same in a prdetermined position under water with respect to the iceberg to be moved, said predetermined position being at the section of the iceberg opposite from the direction of intended movement thereof, said emitting and forming means comprising a network of interconnected tubes each of which is provided with air release ports distributed in a spaced relationship over the entire surface thereof, said air release ports being in the form of self-sealing slits which effectively prevent passage of air below a predetermined pressure, said providing means being connected to said network of interconnected tubes in such manner that air pumped into said network and discharged therefrom forms a continuous wall of air bubbles surrounding and acting against a substantial portion of the submerged iceberg at the section thereof opposite from the direction of the intended movement of the same, thereby elevating the water level around said portion of the iceberg, and causing the iceberg to move away from said wall of air bubbles and in the direction of intended movement thereof.

19. Apparatus as claimed in claim 18 wherein said means for providing air pressure to said bubble emitting means comprises an air compressor.

20. Apparatus a claimed in claim 19, wherein said air compressor is disposed upon one or more water vehicles.

21. Apparatus as claimed in claim 20, wherein said means for moving said bubble emitting means comprises towing cables connected to said one or more water vehicles.

22. Apparatus as claimed in claim 21, further comprising controlled aileron means connected to said towing cables to maintain a depth position of the cable and attached bubble emitting means.

23. Apparatus as claimed in claim 18, wherein said means for moving and maintaining the position of said bubble emitting means comprises cable support means attached to the bubble emitting means and suspended from a portion of the iceberg.

24. Apparatus as claimed in claim 18, wherein the network of interconnected tubes is secured to a submerged portion of the peripheral surface of the iceberg, at the section thereof opposite from the direction of intended movement of the same.

* * * * *